US008151372B2

(12) United States Patent
Densmore et al.

(10) Patent No.: US 8,151,372 B2
(45) Date of Patent: Apr. 10, 2012

(54) BREAST FEEDING COVER

(76) Inventors: Allan Densmore, Nampa, ID (US); Anna Densmore, Nampa, ID (US)

( * ) Notice: Subject to any disclaimer, the term of this patent is extended or adjusted under 35 U.S.C. 154(b) by 65 days.

(21) Appl. No.: 12/775,261

(22) Filed: May 6, 2010

(65) Prior Publication Data

US 2010/0281598 A1 Nov. 11, 2010

Related U.S. Application Data

(60) Provisional application No. 61/175,850, filed on May 6, 2009.

(51) Int. Cl.
*A41D 1/20* (2006.01)
*A41D 1/22* (2006.01)

(52) U.S. Cl. ..... 2/104; 2/48

(58) Field of Classification Search ..... 2/104, 49.1, 2/49.2, 88, 48, 50, 51, 106, 69, 89, 109, 255–264, 2/49.3, 52, 46, 105
See application file for complete search history.

(56) References Cited

U.S. PATENT DOCUMENTS

| | | | | | |
|---|---|---|---|---|---|
| 4,584 | A | * | 6/1846 | Hough | 2/216 |
| 851,107 | A | * | 4/1907 | Rink | 24/8 |
| 1,592,283 | A | * | 7/1926 | McKenzie | 2/48 |
| 2,136,983 | A | * | 11/1938 | Quinn | 2/48 |
| 2,412,415 | A | * | 12/1946 | Navon | 2/84 |
| 2,517,357 | A | * | 8/1950 | Schlegel, Jr. | 2/49.2 |
| 2,789,289 | A | * | 4/1957 | Stevens et al. | 2/52 |
| 2,907,042 | A | * | 10/1959 | Murphy | 2/48 |
| 3,010,111 | A | * | 11/1961 | Ralph | 2/49.3 |
| 4,631,754 | A | * | 12/1986 | Ryan | 2/104 |
| 4,995,116 | A | | 2/1991 | Beauchamp et al. | |
| 5,034,999 | A | | 7/1991 | Lubbers | |
| 5,090,059 | A | | 2/1992 | Kahl | |
| 5,259,068 | A | | 11/1993 | Carroll | |
| 5,469,582 | A | * | 11/1995 | Livingston | 2/104 |
| 5,479,662 | A | * | 1/1996 | Runco | 2/104 |
| 5,544,364 | A | | 8/1996 | Weber | |
| 5,652,958 | A | * | 8/1997 | Farrell-Mestas | 2/48 |
| 5,765,225 | A | * | 6/1998 | Goeckeritz et al. | 2/49.1 |
| 5,848,439 | A | | 12/1998 | Huseth et al. | |
| 6,216,274 | B1 | | 4/2001 | Harris | |
| 6,732,375 | B2 | * | 5/2004 | Nornes | 2/49.1 |
| 7,114,191 | B1 | * | 10/2006 | Butler-Penenberg | 2/104 |

(Continued)

FOREIGN PATENT DOCUMENTS

JP 09003704 * 1/1997

OTHER PUBLICATIONS http://www.folksy.com/items/689, Pixie Patterns Easy 5 Minute Breastfeeding Cover Pattern.

(Continued)

*Primary Examiner* — Amy Vanatta
(74) *Attorney, Agent, or Firm* — Robert L. Shaver; Dykas & Shaver, LLP

(57) ABSTRACT

Presented is a nursing cover with a neck strap which attaches the cover to a nursing mother's neck. The cover body of the device covers the nursing mother's front torso, and specifically covers a nursing infant. The cover includes structure which holds the cover slightly away from the nursing infant, so that the mother can see the nursing infant but the infant is otherwise covered while it is nursing.

9 Claims, 1 Drawing Sheet

U.S. PATENT DOCUMENTS

| | | | | |
|---|---|---|---|---|
| 7,207,070 | B1 | 4/2007 | Swarez-Ballesteros | |
| 7,380,284 | B1 * | 6/2008 | Dodani | 2/49.1 |
| 7,406,718 | B2 | 8/2008 | Ekelund | |
| 7,409,727 | B2 | 8/2008 | Ekelund | |
| 2006/0059597 | A1 * | 3/2006 | LaRocco | 2/49.1 |
| 2007/0277293 | A1 * | 12/2007 | Koepp | 2/256 |
| 2011/0023209 | A1 * | 2/2011 | Ekelund et al. | 2/104 |

OTHER PUBLICATIONS http://www.shopbabybliss.com/product.php?id=2734, Hooter Hiders—Pocket Nursing Cover Up.

http://www.bunnyhug.ca/products.html, Bunnyhug, the discreet breastfeeding cover-up.

http://www.onestopbaby.com/nursingneeds.html, Reversible Nursing Cover, Reversible Nursing Cover, Long Length.

http://www.lovedbaby.com/shop/nursingshawl.php, L'ovedbaby Nursing Shawl.

http://www.bebeaulait.com/bebe-au-lait.php?gclid=CNS-8tbd8KECFQVYbQod8XW8LA, Nursing Covers for Chic Mothers.

http://www.kaboodle.com/reviews/nursing-shawl-for-breastfeeding-cover-up, The Discreet Nursing Cover.

* cited by examiner

BREAST FEEDING COVER

PRIORITY

This application claims the benefit of U.S. Provisional Application No. 61/175,850, filed May 6, 2009, the disclosure of which is incorporated by reference.

TECHNICAL FIELD

The invention generally relates to modesty coverings for nursing mothers, and more specifically to a cover which attaches to the neck of a woman and covers a nursing baby.

BACKGROUND

There are many privacy covers available to a nursing mother, and a simple towel may also be used for that purpose. However all of these prior art privacy covers fail to deliver in two areas. All of them tend to collapse in on the nursing baby and reduce the amount of breathing space for the baby. They also tend to lie flat on the nursing baby and thus do not provide the mother a viewing space in which she can observe the baby nursing, while still maintaining privacy. Both of these features are desirable to nursing mothers and the present invention is designed to provide them.

SUMMARY

The invention is a shawl, cover, or drape which can be utilized when a mother breast feeds a baby in order to provide privacy for the mother and baby, and allows the mother to see the baby while it is covered from view. The cover also provides an air space for the infant to keep it from becoming too hot.

The present invention includes a cover body which is configured to cover a nursing mother's upper torso. The cover body includes a top edge for placement against or adjacent to the nursing mother's neck. The top edge has a slight curve to it. The cover body also has a left and a right side edge which can be straight or be formed of an upper edge and a lower edge, at slightly different angles. The left and right side edges join a bottom edge which is generally a straight edge. Attached to the curving top edge is a neck strap which is designed to go around the nursing mother's neck. It is separable and is joined by use of a fastener of some kind which also has an adjustment to adjust the length of the neck strap. The fastener can be a buckle, or of Velcro fastening material, or any suitable connecting device.

The top edge of the cover body is designed to lay against the mother's upper chest with sufficient gap between the neck and the top edge so that the mother can look down through the gap and see the baby nursing. The top edge of the cover body is held away from the mother's neck and chest area by a number of stiffeners which are built into the upper part of the cover body.

The stiffeners are generally elongate pieces of stiff structures, which are called in the sewing arts as boning. They can be made from steel inserts, pipe cleaners, bendable plastic or plastic strips which are preformed into a curving or bent shape. The stiffening strips are generally mounted to the fabric so that they radiate away from the nursing mother's neck. The stiffness they provide to this part of the cover body results in a gap, or they can be formed into a gap, along the top edge of the cover body so that the mother can look down at the baby as it is nursing.

Optionally, the cover body will have incorporated into it one or more pockets where the nursing mother may hold incidental items such as safety pins, medications, or other useful small items.

By the use of the stiffening strips, the nursing body forms a viewing window between the mother and the baby. This viewing window will not collapse as other privacy covers for nursing do, and additionally provides more ventilation for the baby in order to increase the amount of fresh air the baby receives while it is under the cover.

The nursing body of the invention can also be in another shape, one in which the left and right sides are generally straight, and radiate away from the point at which they join the top edge, with their bottom edge attaching to a generally straight bottom edge.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept (s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

PREFERRED EMBODIMENT

Figure 1:
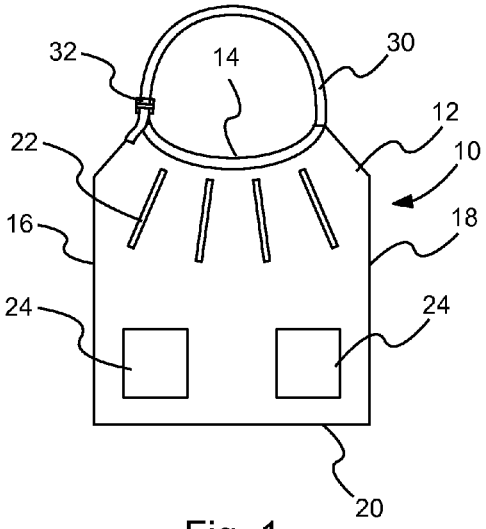
FIG. 1 is a front view of the disclosed breast feeding cover.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

Figure 2:
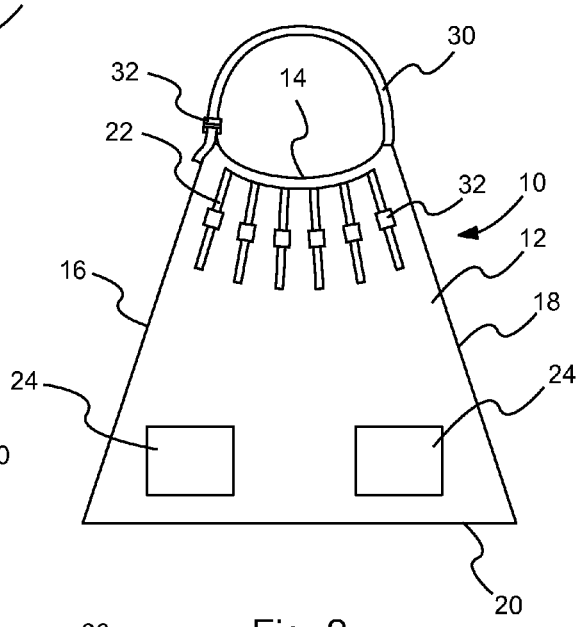
FIG. 2 is a front view of an alternative embodiment of the disclosed breast feeding cover.
Figure 3:
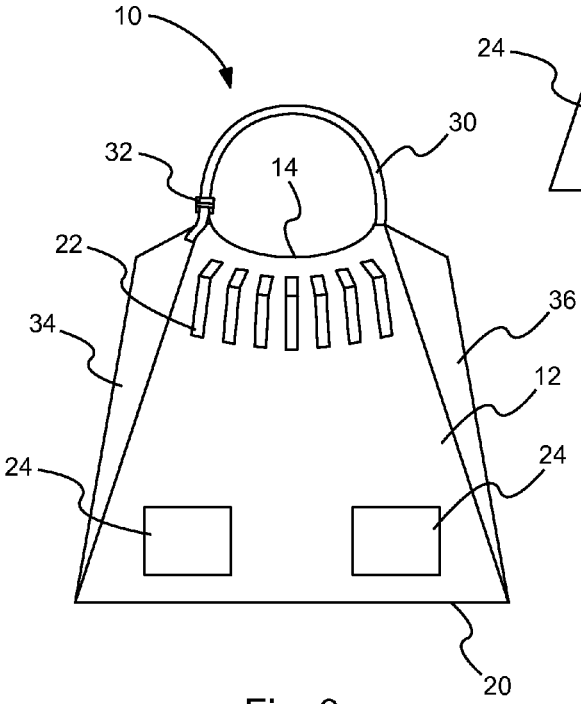
FIG. 3 is a front view of an alternative embodiment of the disclosed breast feeding cover.

Shown in FIGS. 1-3 are several preferred embodiments of the invention. Shown in FIG. 1 is the nursing cover 10 of the invention which includes a cover body 12, a neck strap 30, and a fastener on the neck strap 32, for adjusting the length of the neck strap. It also has a top edge 14, a bottom edge 20, a left edge 16, and a right edge 18. Shown in FIG. 1 are stiffening strips 22, and pockets 24. The stiffening strips 22 can be adjusted by the user to form into an arch to provide breathing space for a nursing infant, and to form a view space around the top edge 14 so that the nursing mother can see the nursing baby. The pockets 24 are optional and may be provided to hold incidentals related to babies, such as a burp rag, pacifier, or other items. The pockets 24 may be on the outside as shown in FIG. 1, or they may be on the inside surface where they would be less visible. The stiffeners 22 can be formed of boning material. The top edge 14 can also be made of boning.

Boning refers to a strong flexible material which can be made of a number of different materials. For instance, boning can be made of spring steel, spiral steel, plastic, can be made of hoops, can be a long strip with perforations in the strip, can be as wide as an inch but is typically much more narrow than that, and can be made of stiff polyester which may be sewn through. Boning has the characteristic of being rigid, but typically being shapeable into a 3-dimensional form, and being able to be sewn into fabric such as in a pocket sized for the particular strip of boning.

The purpose of the boning in this application is to allow proper viewing of the breast feeding infant without compromising the privacy of the nursing mother and the baby. The boning would allow an air pocket to be formed over the baby.

FIG. 2 is a different configuration of the invention, which has similar features as FIG. 1. It has a neck strap 30, a cover body 12, a top edge 14, a left edge 16, a right edge 18, a bottom edge 20, and optional pockets 24. This version includes stiffening strips 22 which are arranged in a radial fashion around the curvature of the top edge 14. The stiffening strips 22, or boning, are enclosed in fabric pockets and include a fastener 32 to allow the user to adjust the length of boning.

FIG. 3 is a different preferred embodiment of the nursing cover 10 and includes a neck strap 30, a cover body 12, stiffening strips 22, a fastener 32 on the neck strap, and pockets 24. FIG. 3 differs from FIG. 2 in that it includes an additional panel of material forming a left wing 34 and a right wing 36.

The cover body can be made of a number of different materials including polyester, nylon, cotton, or other suitable materials. A type of buckle which has been found to be useful is a D Ring buckle and an overall buckle, the D Ring buckle is made by the Bag's & Totes company and the overall buckle is made by the Dritz company. A preferred type of boning is plastic boning, which is 8.5 inches long and ¼ inches wide, made of flexible plastic, and may be provided by Corsetmaking.com or any other plastic boning manufacturing company. The bottom edge 20 is preferably between 33 inches and 36 inches in length. The top edge 14 is preferably curved, and is approximately 18 inches from the left side to the right side.

The left and right sides 16 and 18 are preferably between 24 inches and 28 inches in length, and join the top edge 14 and the bottom edge 20. The neck strap 30 may be made of a number of suitable materials including nylon webbing, cotton, polyester, nylon, or other types of material. The neck strap 30 is preferably about 1.5 inches wide and 28 inches in length, which is suitable to go around the neck of most users.

While certain exemplary embodiments are shown in Figures and in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

We claim:

1. A nursing cover for use by a nursing mother when breast feeding an infant, comprising:

a cover body configured for covering a woman's front torso, with said cover body comprising a curving top edge, a left and right edge, and a bottom edge, also comprising a neck attachment strap attached to a left side and a right side of said top edge, and a plurality of moldable stiffening strips in fabric pockets, said stiffening strips extending from said top edge in a generally radial configuration, for forming and retaining a selected shape in said cover body which is capable of retaining a breathing space for a baby, and a viewing space for said nursing mother, by holding said cover body away from the mother's upper chest.

2. The nursing cover of claim 1 in which said stiffening strips comprise a number of strips which are at least 5 times longer than their width, with said stiffening strips attached to said cover body in a generally radial configuration from said top edge.

3. The nursing cover of claim 2 in which said stiffening strips are attached to said cover body with one end mounted adjacent to said top edge.

4. The nursing cover of claim 1 which further comprises one or more pockets for holding incidentals.

5. The nursing cover of claim 1 which when laid flat displays a curving top edge, with said left and right sides being generally radial to said top edge, and with said bottom edge forming a straight edge.

6. The nursing cover of claim 1 which when laid flat displays a curving top edge, with said left and right sides being comprised of a generally radial portion, and a second portion which joins said bottom edge at approximately a ninety degree angle, with said bottom edge forming a straight edge.

7. The nursing cover of claim 2 in which said stiffening strips are formed of boning structures.

8. The nursing cover of claim 2 in which said stiffening strips are formed of pipe cleaners.

9. The nursing cover of claim 2 in which said stiffening strips are formed of bendable plastic strips.

* * * * *